United States Patent [19]

Schmittou

[11] 4,043,172

[45] Aug. 23, 1977

[54] TUBE COMPRESSOR

[76] Inventor: Louis A. Schmittou, 1304 Latham, Memphis, Tenn. 38106

[21] Appl. No.: 694,888

[22] Filed: June 10, 1976

[51] Int. Cl.[2] ..... B21D 41/04

[52] U.S. Cl. ..... 72/402; 72/409

[58] Field of Search ..... 72/402, 452, 457, 399, 72/409, 410

[56] References Cited

U.S. PATENT DOCUMENTS

| | | | |
|---|---|---|---|
| 579,214 | 3/1897 | Adams | 72/402 |
| 3,217,519 | 11/1965 | Demler | 72/402 |
| 3,234,776 | 2/1966 | Stoltz | 72/402 |
| 3,417,598 | 12/1968 | Valente | 72/402 |
| 3,626,450 | 12/1971 | Browne | 72/402 |
| 3,879,834 | 4/1975 | Johnson | 72/402 |

FOREIGN PATENT DOCUMENTS

| | | | |
|---|---|---|---|
| 649,644 | 10/1962 | Canada | 72/402 |

*Primary Examiner*—C.W. Lanham
*Assistant Examiner*—Gene P. Crosby
*Attorney, Agent, or Firm*—John R. Walker, III

[57] ABSTRACT

A device for use by plumbers and the like to compress the end of a length of hollow metal tubing such as a copper water pipe which has been expanded to a size greater than its normal diameter. The device allows such tubing to be compressed back to its normal diameter. A manually operable cam causes a hollow sleeve to move back and forth. The sleeve in turn causes a plurality of die members to move inwardly when the cam is activated. The sleeve is provided with a sloping inner surface and each of the plurality of die members is provided with a sloping outer surface having substantially the same angle of slope as the inner surface of the sleeve so that when the sleeve is moved by the cam, the plurality of die members will be uniformly forced inwardly to compress the end of a length of tubing inserted therebetween in a straight, uniform manner.

10 Claims, 9 Drawing Figures

TUBE COMPRESSOR

BACKGROUND OF THE INVENTION

1. Field of the Invention

This invention relates generally to tools for use by plumbers and the like and more specifically to plumbing tools for compressing the ends of hollow metal tubing.

2. Description of the Prior Art

Heretofore, various tools have been developed for use on metal tubing and the like to swag, taper, bead, crimp, and point the metal tubing and the like. See, for example, Adams, U.S. Pat. No. 579,214; Dewar, U.S. Pat. No. 2,197,099; Demler, U.S. Pat. No. 3,217,519; Galan et al, U.S. Pat. No. 3,455,140; Brown, U.S. Pat. No. 3,626,450; and Jackman, U.S. Pat. No. 3,802,244. None of the above references disclose or suggest the present invention.

Hollow, thin wall copper tubing is typically used to convey water in modern buildings. When water in such tubing freezes, the tubing swells or expands to a size greater than its normal outside diameter. Often, this causes the tubing to burst. The normal procedure for remedying such faults is to cut the burst part of the tubing out and insert a standard fitting between the two ends of the tubing. However, this procedure is not entirely satisfactory. More specifically, the standard fitting is made with an inside diameter that corresponds to the outside diameter of the size tubing it is to be used with. For example, ⅜ inch copper tubing has a ½ inch outside diameter and a standard fitting to be used with ⅜ inch copper tubing has a ½ inch inside diameter. Thus, where such a standard fitting is to be used to join together the two ends of a ⅜ inch copper tubing that has been cut in two as discussed above, unless all of the swelled, enlarged portion of the tubing is removed, the ends of the tubing will not fit into the standard fitting. Since it is often difficult to remove all of the swelled, enlarged portion of the tubing, the only feasible procedure in such a case is to compress the ends of the copper tubing back to substantially their normal outside diameter so that they will fit into the standard fitting. Applicant devised a tool about 20 years ago that was used in a limited extent to compress the expanded end of lengths of copper tubing. This tool consisted of an elongated metal structure having an aperture in one end thereof with an initial diameter sufficient to receive the expanded end of the tubing. The aperture is elongated, extends substantially along the longitudinal axis of the structure, and tapers inwardly so that the tool can be hammered onto the expanded end of the tubing so as to cause the tubing to be compressed inwardly as the tool is hammered thereon.

SUMMARY OF THE INVENTION

The present invention is directed towards overcoming the problems and disadvantages of prior devices for compressing tubing and the like. The concept of the present invention is to provide a portable device which will uniformly compress the end of a length of hollow, cylindrical tubing.

The device of the present invention includes a hollow housing means having an opening therethrough for allowing one end of a length of cylindrical tubing to be inserted into the interior thereof, die means positioned in the interior of the housing means, sleeve means positioned in the interior of the housing means for placement about the die means and for selectively forcing the die means inwardly to compress the end of the length of tubing, and activating means for selectively causing the sleeve means to force the die means inwardly to uniformly compress the end of the length of tubing. The die means includes a plurality of die members for being positioned around the end of the length of tubing in the housing means. Each of the plurality of die members has a sloping outer surface. The sleeve means has a sloping inner surface for coacting with the sloping outer surface of each of the plurality of die members to uniformly force the plurality of die members inwardly when activated by the activating means. The activating means includes a cam means pivotally attached to the housing means and includes a cam follower means fixedly attached to the sleeve means for causing the sleeve means to force the plurality of die members inwardly to compress the end of the length of tubing in response to movement of the cam means.

DESCRIPTION OF THE PREFERRED EMBODIMENT

Figure 1:
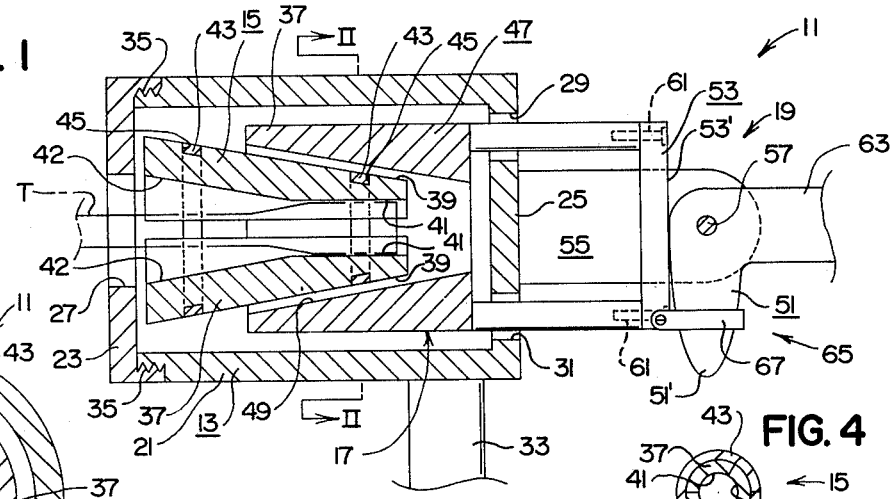
FIG. 1 is a partially sectional side view of the tube compressor of the present invention showing the end of a length of tubing in phantom lines.

The device 11 of the present invention is for use to compress the end of a length of cylindrical tubing T. The device 11 is particularly adapted to be used by plumbers and the like to compress in a straight, uniform manner the ends of a length of cylindrical metal tubing, such as copper water pipes or the like, which has been swelled or expanded to a size greater than its normal outside diameter. The device 11 includes, in general, a hollow housing means 13, a die means 15 positioned within the hollow housing means 13, a sleeve means 17 positioned within the hollow housing means 13, and an activating means 19 mounted on the housing means 13 in communication with the sleeve means 17.

The housing means 13 preferably includes a hollow, cylindrical body 21 and a first end portion 23 closing off one end of the body 21. A second end portion 25 may be provided to close off the other end of the body 21. An opening 27 is provided through the first end portion 23 for allowing the end of the length of tubing T to be inserted into the interior of the cylindrical body 21 of the housing means 13. The second end portion 25 may be provided with a pair of openings 29, 31 for reasons which will hereinafter become apparent. The housing means 13 may include a handle member 33 of any convenient length for allowing the housing means 13 to be easily held by the user thereof. The housing means preferably includes a removable portion for allowing access into the interior thereof for reasons which will hereinafter become apparent. For example, the first end portion 23 may be removably attached to the body 21 by means of screw threads 35 in a manner well known to those skilled in the art. It should be noted that the second end 25 may be removably mounted to the body 21 in the same manner as heretofore discussed relative to the first end portion 23. The housing means 13 is preferably constructed of metal or the like in any manner well known to those skilled in the art.

Figure 2:
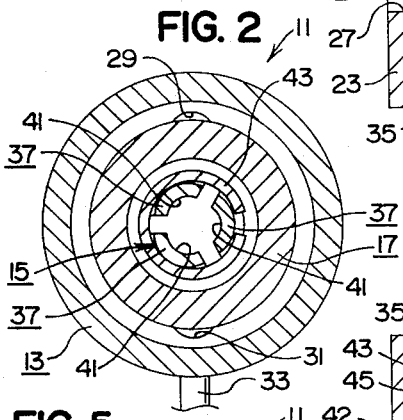
FIG. 2 is a cross-sectional view of the tube compressor of the present invention as taken on line II—II of FIG. 1.
Figure 4:
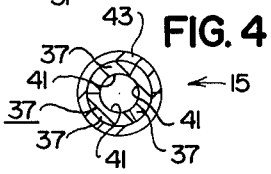
FIG. 4 is a cross-sectional view of the die means of the tube compressor of the present invention as taken on line IV—IV of FIG. 3.

The die means 15 preferably includes a plurality of die members 37 for being positioned around the end of the length of tubing T in the housing means 13. Although the die means 15 may include any number of die members 37, three such die members 37 are shown in the drawings (see FIGS. 2 and 4). Each of the plurality of die members 37 has a longitudinally sloping outer surface 39. Additionally, each of the plurality of die members 37 has a transversally curved inner surface 41. The curved inner surface 41 of each of the plurality of die members 37 has substantially the same curvature as the desired diameter of the end of the length of tubing T. Furthermore, each of the plurality of die members 37 may have a longitudinally sloping inner surface 42 extending from the curved inner surface 41 thereof as shown in the drawing for allowing the end of the length of tubing T to be easily inserted into the die means 15. More specifically, the sloping inner surface 42 acts as a guide to direct the end of the length of tubing T to the curved inner surfaces 41 of the plurality of die members 37. The die means 15 may include one or more spring members 43 (two being shown in the drawing) for holding the plurality of die members 37 together. Each of the plurality of die members 37 may include a transverse groove 35 for receiving each spring member 43.

Figure 8:
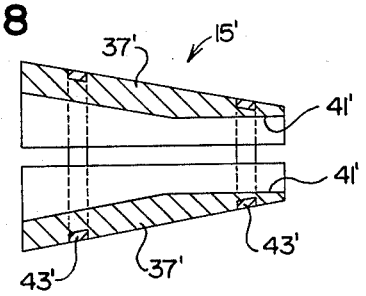
FIG. 8 is a sectional side view of an additional die means for use with the present invention to compress a different size tubing than the die means shown in FIG. 1, 2, 3 and 4.
Figure 9:
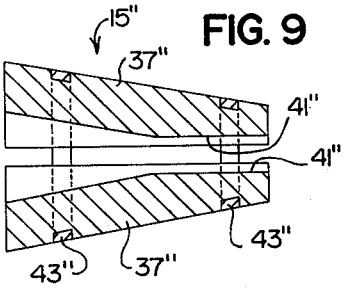
FIG. 9 is a sectional view of another additional die means for use with the present invention to compress a different size tubing than the die means shown in FIGS. 1, 2, 3, 4 and 8.

It should be noted that the device 11 may include a number of separate die means 15 for allowing the device 11 to be used on different size tubing T and the like. More specifically, each die means 15 is limited in the size tubing it can accept and in the amount that it can compress such tubing T. For example, a die means 15 that can accept tubing T with a $\frac{5}{8}$ inch outside diameter can only compress that tubing T a certain, limited amount (for example, to a $\frac{1}{2}$ inch outside diameter). Thus, if it is desired to compress the end of a length of tubing T having a $\frac{5}{8}$ inch outside diameter to have a $\frac{3}{8}$ inch outside diameter, it may be necessary to use two die means 15, one capable of compressing the tubing T from a $\frac{5}{8}$ inch outside diameter to a $\frac{1}{2}$ inch outside diameter and one capable of compressing the tubing T from a $\frac{1}{2}$ inch outside diameter to a $\frac{3}{8}$ inch outside diameter. Applicant envisions the device 11 being provided as a set with a number of separate die means 15 for allowing the device 11 to compress the end of a length of tubing T to substantially any standard size. FIGS. 8 and 9 show additional die means 15′, 15– which may be provided with the device 11 to allow the device 11 to compress different size tubing. The die means 15′, 15″ are substantially identical to the die means 15 and include a plurality of die members 37′, 37″ and one or more spring members 43′, 43″. Each of the plurality of die members 37′ include a curved inner surface 41′. Likewise, each of the plurality of die members 37″ include a curved inner surface 41″. The curved inner surfaces 41′, 41″ differ from the curved inner surface 41 and from each other in the curvature thereof. That is, each of the curved inner surfaces 41, 41′, 41″ has the curvature of the outside diameter of a standard size tubing. For example, the curved inner surface 41 may have the curvature of a $\frac{5}{8}$ inch outside diameter tubing, the curved inner surface 41′ may have the curvature of a $\frac{1}{2}$ inch outside diameter tubing, and the curved inner surface 41″ may have the curvature of a $\frac{3}{8}$ inch outside diameter tubing.

The sleeve means 17 includes a substantially cylindrical, hollow body 47 having both ends thereof opened. The body 47 has a longitudinally sloping inner surface 49. The sloping inner surface 49 preferably slopes at substantially the same angle as the sloping outer surfaces 39 of each of the plurality of die members 37 of the die means 15.

Figure 3:
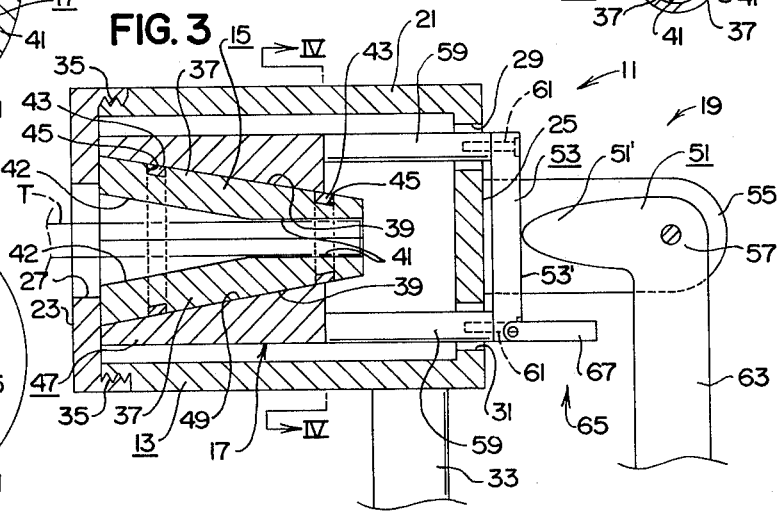
FIG. 3 is a partially sectional side view of the tube compressor of the present invention substantially as shown in FIG. 1 but with the die means, sleeve means, and activating means in a compressed position.
Figure 5:
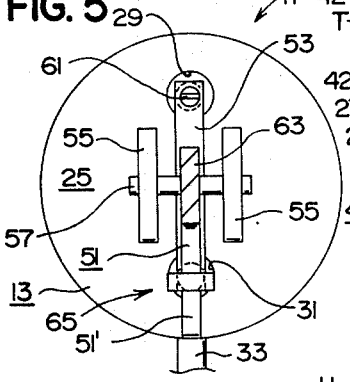
FIG. 5 is a right end view of FIG. 1.
Figure 6:
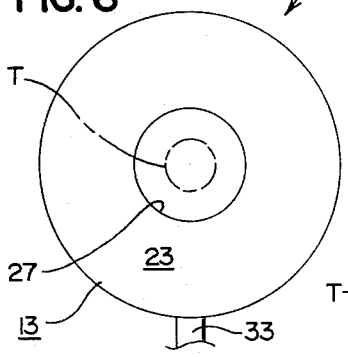
FIG. 6 is a left end view of FIG. 1.
Figure 7:
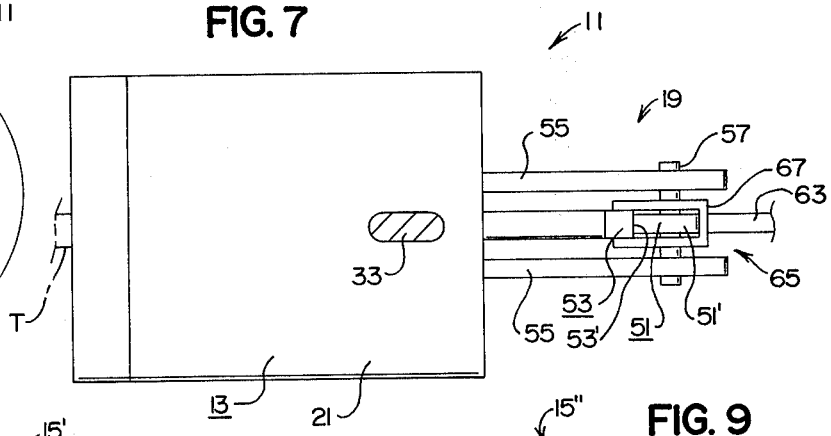
FIG. 7 is a bottom plan view of FIG. 1.

The activating means 19 includes a cam means 51 pivotally attached to the housing means 13 and includes a cam follower means 53 fixedly attached to the sleeve means 17 for causing the sleeve means 17 to force the plurality of die members 37 of the die means 15 inwardly to compress the end of the length of tubing T when the cam means 51 is activated. A pair of ears 55 may be attached to the second end portion 25 of the body 21 of the housing means 13 for allowing the cam means 51 to be pivotally attached to the housing means 13 by means of a pivot rod 57. A pair of posts 59 or the like may be fixedly attached to the rearward end of the body 47 of the sleeve means 17 substantially as shown in FIGS. 1 and 3 for extending rearwardly through the openings 29, 31 in the second end portion 25 of the housing means 13. The cam follower means 53 is fixedly attached to the rearward ends of the pair of posts 59 by screws 61 or the like substantially as shown in the drawings. The cam follower means 53 may consist of an elongated bar having at least one flat surface 53′ for coacting with the cam means 51. The cam means 51 may include a handle member 63 of any convenient length for allowing the cam means 51 to be easily activated.

The device 11 may include attachment means 65 for selectively attaching the sleeve means 17 to the cam means 51 and for causing the sleeve means 17 to move with the cam means 51 when the cam means 51 is moved away from the cam surface means 53, i.e., from the activated position as shown in FIG. 3 to the nonactivated position as shown in FIG. 1. The attachment means 65 may include a loop member 67 fixedly attached to the cam follower means 53 as shown in the drawings. The loop member 67 is of a size and shape and is positioned so as to be engaged by the nose 51′ of the cam means 51 when the cam means 51 is moved from the activated position as shown in FIG. 3 to the nonactivated position as shown in FIG. 1 to pull the sleeve means 17 rearwardly when the cam means 51 is so moved.

To use the device 11 of the present invention to compress the end of a length of tubing T, the first step is to select a die means 15 that will accept and compress that specific size of tubing T and to insert that die means 15 into the interior of the housing means 13 by removing the first end portion 23 of the housing means 13 and removing any die means 15 that may be within the housing means 13. Next, the end of the length of tubing T is inserted into the interior of the housing means 13 through the opening 27 in the first end portion 23 of the housing means 13 until it is positioned within the die means 13 as shown in FIGS. 1 and 3. It should be noted that the die means 15 may be provided with stop means (not shown) such as a lip or the like on the rearward end of one or more of the plurality of die means 37 for preventing the end of the length of tubing T from being inserted past the rearward end of the die means 13 in a manner apparent to those skilled in the art. Once the end of the length of tubing T is inserted into the device 11, the cam means 51 is moved from the position shown in FIG. 1 to the position shown in FIG. 3 to cause the sleeve means 17 to uniformly force the plurality of die means 37 inwardly to compress the end of the length of tubing T. The cam means 51 is then moved from the position shown in FIG. 3 to the position shown in FIG. 1 and the end of the length of tubing T is removed from the device 11. If it is desired to compress the end of the length of tubing T further, the die means 15 will have to be replaced by another die means 15 and the above procedures repeated. It should be noted that the end of the length of tubing T to be compressed may be heated a sufficient amount to make it softer so that it can be compressed easier in a manner well known to those skilled in the art. Additionally, it should be noted that the surface of each moving component of the device 11 may be covered with a coating of oil or the like to prevent undue wear and that should undue wear of any such moving component occur, the construction of the device 11 allows that component to be easily replaced with a new component.

As thus constructed and used, the present invention provides a portable device which will uniformly compress the end of a length of tubing.

Although the invention has been described and illustrated with respect to a preferred embodiment thereof, it is not to be so limited since changes and modifications may be made therein which are within the full intended scope of the invention.

I claim:

1. A portable device for compressing the end of a length of cylindrical tubing which has been expanded to a size greater than its normal diameter, said device comprising:

a. hollow housing means having an opening therethrough for allowing the expanded end of the length of tubing to be inserted into the interior of said housing means;

b. die means positioned in the interior of said housing means, said die means including a plurality of die members for being positioned around the length of tubing in said housing means, each of said plurality of die members having a sloping outer surface and having a curved inner surface for engaging the expanded end of the tubing, said curved inner surface of each of said plurality of die members having substantially the same curvature as the normal diameter of the tubing;

c. sleeve means positioned in the interior of said housing means for placement about said die means and for forcing said plurality of die members inwardly to compress the end of the length of the tubing, said sleeve means having a sloping inner surface; and d. activating means for selectively causing said sleeve means to force said plurality of die members inwardly to uniformly compress the expanded end of the length of tubing, said activating means including cam means pivotally attached to said housing means and including cam follower means fixedly attached to said sleeve means for causing said sleeve means to force said plurality of die members inwardly to compress the expanded end of the length of tubing when said cam means is activated.

2. The device of claim 1 in which said die means includes a spring member for holding said plurality of die members together.

3. The device of claim 2 in which said housing means includes a removable portion for allowing access into the interior of said housing means.

4. The device of claim 3 in which said housing means includes a handle member for allowing said housing means to be easily held.

5. The device of claim 4 in which is included attachment means for attaching said sleeve means to said cam means and for causing said sleeve means to move with said cam means when said cam means is moved away from said cam surface means.

6. A portable device for compressing the end of a length of a cylindrical metal tubing, which has been expanded to a size greater than its normal diameter, back to its normal diameter, said device comprising:

a. hollow housing means having an opening through one end thereof for allowing the end of the metal tubing to be inserted therethrough into the interior of said housing means, said housing means including a removable portion for allowing access into the interior of said housing means;

b. die means positioned within said housing means, said die means including a plurality of die members for being positioned around the length of tubing in said housing means, each of said plurality of die members having a sloping outer surface, each of said plurality of die members having a curved inner surface, said curved inner surface of each of said plurality of die members having substantially the same curvature as the normal diameter of the end of the length of tubing, said die means including spring means for holding said plurality of die members together;

c. sleeve means positioned in the interior of said housing means for placement about said die means and for forcing said plurality of die members inwardly to compress the end of the length of the tubing, said sleeve means having a sloping inner surface, said inner surface sloping at substantially the same angle as said outer surface of each of said plurality of die members of said die means;

d. activating means for selectively causing said sleeve means to force said plurality of die members inwardly to compress the end of the length of tubing, said activating means including cam means pivotally attached to said housing means and including cam follower means fixedly attached to said sleeve means for causing said sleeve means to move in response to said cam means and for causing said sleeve means to force said plurality of die means inwardly to compress the end of the length of tubing; and e. attachment means for attaching said sleeve means to said cam means and for causing said sleeve means to move with said cam means when said cam means is moved away from said cam surface means.

7. The device of claim 6 in which said housing means includes a handle member for allowing said housing means to be easily held.

8. The device of claim 6 in which said cam means includes a handle member for allowing said cam means to be easily activated.

9. The device of claim 6 in which said attachment means includes a loop member fixedly attached to said cam follower means of said activating means.

10. A method of compressing the end of a length of cylindrical metal tubing which has been expanded to a size greater than its normal diameter, said method comprising:

a. inserting said expanded end of said tubing into a portable device which comprises: a hollow housing means having an opening through one end thereof for allowing said expanded end of said tubing to be inserted therethrough into the interior of said housing means, said housing means including a removable portion for allowing access into the interior of said housing means; die means positioned within said housing means, said die means including a plurality of die members for being positioned around said expanded end of said tubing in said housing means, each of said plurality of die members having an outer surface sloping in a direction aligned with the longitudinal axis thereof and having an inner surface curving in a direction transverse to the longitudinal axis thereof, said curved inner surface of each of said plurality of die members having substantially the same curvature as the normal diameter of said end of said tubing; sleeve means positioned substantially in the interior of said housing means for placement about said die means and for forcing said plurality of die members inwardly to compress the end of the length of tubing, said sleeve means having an inner surface sloping in a direction aligned with the longitudinal axis thereof, said sloping inner surface having substantially the same slope as said sloping outer surface of each of said plurality of die members of said die means; and activating means for selectively causing said sleeve means to force said plurality of die members inwardly to compress said expanded end of said tubing, said activating means including a cam means pivotally attached to said housing means and including a cam follower means fixedly attached to said sleeve means for causing said sleeve means to move in response to said sleeve means to force said plurality of die members inwardly to compress said expanded end of said tubing; and b. activating said activating means of said device to cause said plurality of die members of said device to be forced inwardly to compress said expanded end of said tubing.

* * * * *